US007171881B2

(12) United States Patent
Ripley

(10) Patent No.: US 7,171,881 B2
(45) Date of Patent: Feb. 6, 2007

(54) ANGLED PRODUCT TRANSFER CONVEYOR

(75) Inventor: Scott Alan Ripley, River Falls, WI (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 11/136,822

(22) Filed: May 25, 2005

(65) Prior Publication Data

US 2005/0217980 A1 Oct. 6, 2005

Related U.S. Application Data

(62) Division of application No. 10/116,323, filed on Apr. 3, 2002, now abandoned.

(51) Int. Cl.
*B26D 7/06* (2006.01)

(52) U.S. Cl. ..... 83/113; 83/152

(58) Field of Classification Search ..... 83/110–113, 83/152, 155, 331, 339; 271/196, 197; 198/689.1
See application file for complete search history.

(56) References Cited

U.S. PATENT DOCUMENTS

| | | | | |
|---|---|---|---|---|
| 3,178,041 | A | | 4/1965 | Wheat et al. |
| 3,285,112 | A | | 11/1966 | Dale et al. |
| 3,291,282 | A | * | 12/1966 | Pedagno ..... 271/197 |
| 3,477,558 | A | | 11/1969 | Fleischauer |
| 3,861,259 | A | | 1/1975 | Hitch |
| 3,946,920 | A | | 3/1976 | Jordan et al. |
| 4,112,827 | A | | 9/1978 | Kang |
| 4,143,871 | A | | 3/1979 | Blessing |
| 4,168,772 | A | | 9/1979 | Eberle |
| 4,200,016 | A | * | 4/1980 | Helmig et al. ..... 271/197 |
| 4,236,814 | A | | 12/1980 | Tonkin |
| 4,360,260 | A | | 11/1982 | Eloranta et al. |
| 4,362,380 | A | * | 12/1982 | Dragstedt ..... 271/108 |
| 4,381,596 | A | | 5/1983 | Simonton et al. |
| 4,534,549 | A | | 8/1985 | Eberle |
| 4,591,139 | A | | 5/1986 | Engelbart |
| 4,668,324 | A | | 5/1987 | Burns |
| 4,676,862 | A | | 6/1987 | Kuchnert |
| 4,728,093 | A | | 3/1988 | Eberle |
| 4,784,380 | A | | 11/1988 | Eberle |
| 4,819,928 | A | | 4/1989 | Osborn et al. |
| 4,887,858 | A | | 12/1989 | Gazzarrini |
| 5,031,002 | A | | 7/1991 | Yaguchi |
| 5,048,182 | A | | 9/1991 | Robbins, III |
| 5,061,337 | A | | 10/1991 | Fraser |

(Continued)

FOREIGN PATENT DOCUMENTS

| | | |
|---|---|---|
| AT | 314 323 B | 3/1974 |

(Continued)

*Primary Examiner*—Stephen Choi
(74) *Attorney, Agent, or Firm*—Philip Y. Dahl

(57) ABSTRACT

A vacuum conveyor is provided comprising an endless perforated belt which extends over a first vacuum plate and a second vacuum plate, which vacuum plates may be maintained at different air pressures and may be situated at different angles relative to horizontal. An apparatus for cutting and transporting sheet materials is provided comprising the vacuum conveyor according to the present invention and a rotary die cutter situated such that an emerging portion of a cut workpiece can become held by the vacuum conveyor before it is fully separated, enabling pattern-cut sheet materials to be cut and transported to a destination such as a laminating nip with accurate registration.

9 Claims, 2 Drawing Sheets

U.S. PATENT DOCUMENTS

| | | | | |
|---|---|---|---|---|
| 5,063,415 | A | | 11/1991 | Ariyama |
| 5,078,375 | A | | 1/1992 | Steidinger |
| 5,133,543 | A | | 7/1992 | Eitel et al. |
| 5,140,872 | A | | 8/1992 | Holliday et al. |
| 5,456,871 | A | | 10/1995 | Harada et al. |
| 5,556,499 | A | | 9/1996 | Clough |
| 5,588,967 | A | | 12/1996 | Lemp et al. |
| 5,596,897 | A | | 1/1997 | Payne, Jr. et al. |
| 5,761,793 | A | | 6/1998 | Bevers et al. |
| 5,762,753 | A | | 6/1998 | Clough |
| 5,783,024 | A | | 7/1998 | Forkert |
| 5,791,185 | A | | 8/1998 | Bodnar |
| 5,810,350 | A | * | 9/1998 | Pollich ..... 271/197 |
| 5,989,747 | A | | 11/1999 | Tanaka et al. |
| 6,007,660 | A | | 12/1999 | Forkert |
| 6,066,409 | A | | 5/2000 | Ronne et al. |
| 6,159,327 | A | | 12/2000 | Forkert |
| 6,224,203 | B1 | | 5/2001 | Wotton et al. |
| 6,241,839 | B1 | | 6/2001 | Yoshino et al. |
| RE37,366 | E | | 9/2001 | Cox et al. |
| 6,347,585 | B1 | | 2/2002 | Kiamco et al. |
| 6,419,217 | B1 | | 7/2002 | Hartmann et al. |
| 6,500,217 | B1 | | 12/2002 | Starz et al. |
| 6,547,229 | B1 | | 4/2003 | Hanson et al. |
| 6,585,846 | B1 | | 7/2003 | Hanson et al. |
| 6,733,912 | B2 | | 5/2004 | Mlinar |
| 6,740,131 | B2 | | 5/2004 | Schukar et al. |
| 6,749,713 | B2 | | 6/2004 | Mlinar |
| 6,756,146 | B2 | | 6/2004 | Mlinar et al. |
| 6,868,890 | B2 | | 3/2005 | Hirsch |
| 2002/0014509 | A1 | | 2/2002 | Kitai et al. |
| 2002/0134501 | A1 | | 9/2002 | Fan et al. |
| 2002/0136940 | A1 | | 9/2002 | Mao et al. |
| 2003/0188615 | A1 | | 10/2003 | Ripley |
| 2003/0188616 | A1 | | 10/2003 | Behymer |
| 2003/0191021 | A1 | | 10/2003 | Ripley et al. |

FOREIGN PATENT DOCUMENTS

| | | | |
|---|---|---|---|
| BE | 1007774 | A3 | 10/1995 |
| DE | 19 28 110 | A | 12/1970 |
| DE | 26 10 628 | A | 9/1977 |
| DE | 33 43 811 | A1 | 6/1985 |
| DE | 94 00 890.6 | U1 | 3/1994 |
| DE | 195 48 422 | A1 | 9/1997 |
| EP | 0 654 347 | A1 | 11/1994 |
| EP | 1 037 295 | A1 | 9/2000 |
| FR | 2 456 613 | A | 12/1980 |
| GB | 1 084 597 | A | 9/1967 |
| GB | 2101098 | A | 1/1983 |
| JP | 55-98040 | | 7/1980 |
| JP | 57-93854 | | 6/1982 |
| JP | 62-244830 | | 10/1987 |
| JP | 403-128851 | | 5/1991 |
| JP | 403-128853 | | 5/1991 |
| JP | 96335462 | A | 12/1996 |
| JP | 10-166014 | | 6/1998 |
| JP | 11 273663 | A | 10/1999 |
| JP | 11 297314 | A | 10/1999 |
| JP | 99292327 | A | 10/1999 |
| WO | WO 02/43171 | A2 | 5/2002 |
| WO | WO 02/43179 | A1 | 5/2002 |

* cited by examiner

ANGLED PRODUCT TRANSFER CONVEYOR

CROSS REFERENCE TO RELATED APPLICATIONS

This application is a divisional of U.S. application Ser. No. 10/116,323, filed Apr. 3, 2002, now abandoned.

FIELD OF THE INVENTION

This invention relates to a vacuum conveyor for transporting pattern-cut sheet materials which may be used to advantage in conjunction with rotary die cutting apparatus.

BACKGROUND OF THE INVENTION

U.S. Pat. No. 3,285,112 discloses a method and apparatus for sheet handling which includes use of a vacuum belt having a continuous row of spaced perforations along its central longitudinal line which interacts with a single vacuum chamber. The disclosed vacuum belt receives a sheet from a knife cutting mechanism and releases the sheet to a sheet stacking mechanism.

U.S. Pat. No. 3,861,259 discloses a method and apparatus for transporting sheets cut by use of a knife cutting mechanism employing vacuum belt mechanisms.

U.S. Pat. No. 5,078,375 discloses a method and apparatus for transporting webs employing a vacuum drum which also serves as an anvil for cutting the webs.

SUMMARY OF THE INVENTION

Briefly, the present invention provides a vacuum conveyor for transporting sheet materials comprising an endless perforated belt which extends over a first vacuum plate having first longitudinal openings and over a second vacuum plate having second longitudinal openings, where the first and second vacuum plates are situated at different angles relative to horizontal. The first and second longitudinal openings in the first and second vacuum plates may communicate with first and second vacuum chambers, respectively, maintained at first and second sub-ambient air pressures.

In another aspect, the present invention provides an apparatus for cutting and transporting sheet materials comprising a vacuum conveyor comprising an endless perforated belt which extends over first and second vacuum plates, which may be maintained at different pressures and angles relative to horizontal, and a rotary die cutter. The rotary die cutter is adapted to cut a continuous web into cut workpieces, and the vacuum conveyor and rotary die cutter are arranged such that an emerging portion of a cut workpiece may become held by the vacuum conveyor before it is fully separated from the continuous web. The drive mechanism for propelling the endless perforated belt may be geared with the rotary die cutter so that the linear surface velocity of the endless perforated belt is equal to or more typically greater than the linear surface velocity of the rotary die cutter.

What has not been described in the art, and is provided by the present invention, is a vacuum conveyor having two pressure zones at two angles so as to provide differentiated conditions for workpieces entering and leaving the conveyor.

It is an advantage of the present invention to provide an apparatus capable of transporting pattern-cut sheet materials from a rotary die-cutting apparatus to a destination such as a laminating nip with accurate registration.

DETAILED DESCRIPTION OF PREFERRED EMBODIMENTS

Figure 1:
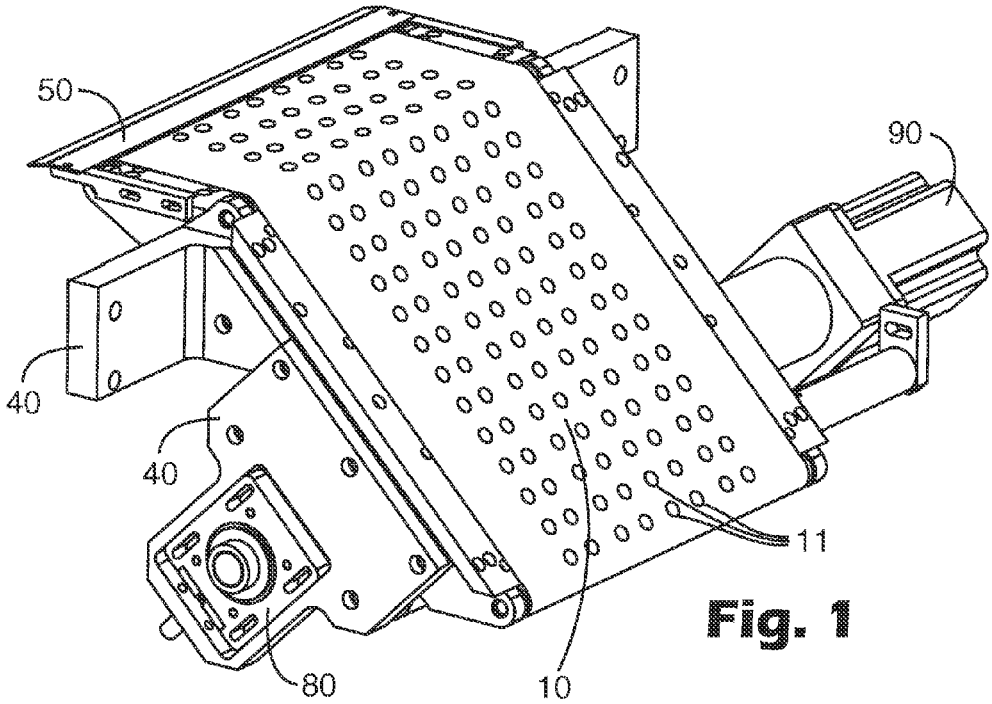
FIG. 1 illustrates a vacuum conveyor according to the present invention.
Figure 2:
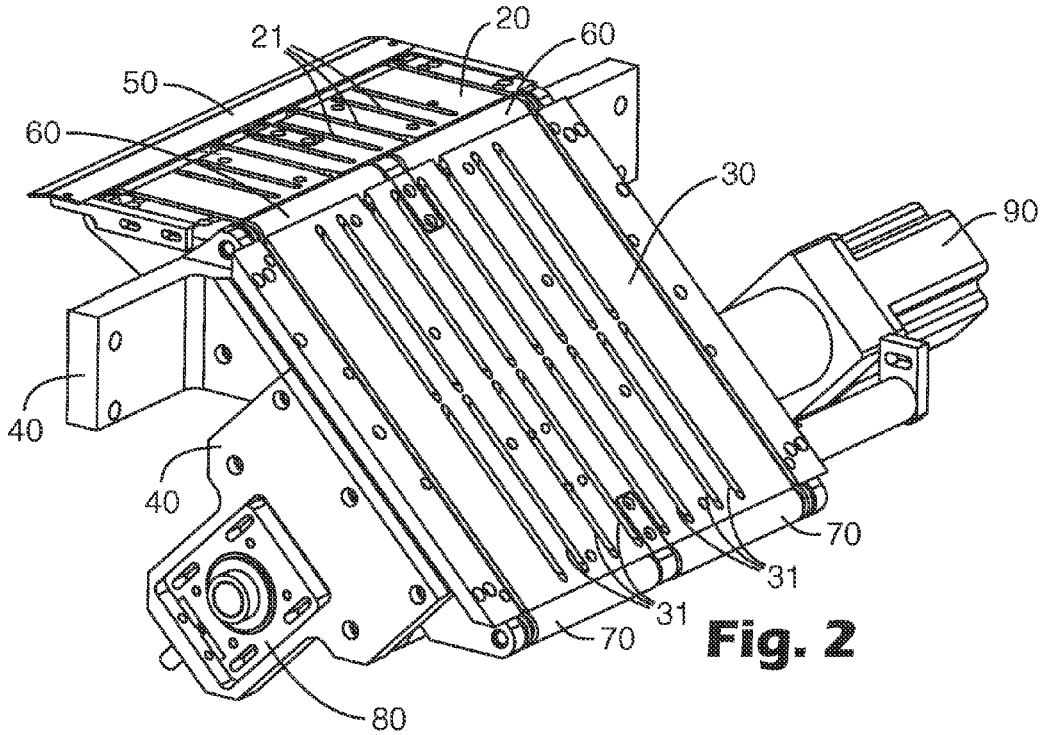
FIG. 2 illustrates the vacuum conveyor depicted in FIG. 1 without the endless perforated belt.

With reference to FIGS. 1 and 2, a vacuum conveyor according to the present invention comprises endless perforated belt 10 perforated with belt holes 11. The belt may be made of any suitable material, including polymers, rubbers, fabrics, composites, and the like, provided that the outer surface is compatible with the workpieces to be transported on the belt. Endless perforated belt 10 passes over first vacuum plate 20 having longitudinal openings 21 and second vacuum plate 30 having longitudinal openings 31. Belt holes 11 are arranged in rows aligned with longitudinal openings 21, 31. Typically, each vacuum plate 20, 30 has at least two longitudinal openings 21, 31 aligned with at least two rows of belt holes 11. More typically, each vacuum plate 20, 30 has four or more longitudinal openings 21, 31 aligned with four or more rows of belt holes 11, so as to enable the vacuum conveyor to grip workpieces of varying sizes across the majority of their width. Typically workpieces might include thin sheet materials die-cut in arbitrary shapes, as discussed more fully below. In the embodiment as depicted, endless perforated belt 10 is typically driven in the clockwise direction toward the vacuum plate which angles downward for delivery of the workpiece.

Longitudinal openings 21, 31 in first and second vacuum plates 20, 30 communicate with first and second vacuum chambers (not shown), respectively. First and second vacuum chambers are maintained at first and second sub-ambient air pressures, such that the sub-ambient air pressures tend to hold workpieces to endless perforated belt 10. First and second sub-ambient air pressures may be the same or different. Where first and second sub-ambient air pressures are different, the first sub-ambient air pressure is typically less than the second, enabling the conveyor to better hold workpieces coming onto the conveyor at locations over first vacuum plate 20 and release workpieces leaving the conveyor from locations over second vacuum plate 30. The first and second vacuum chambers are maintained at first and second sub-ambient air pressures by any suitable means. The vacuum chambers may be functionally connected to one or more sources of sub-ambient air pressure such as vacuum pumps and the like.

First vacuum plate 20 is situated at a first angle relative to horizontal, which is approximately 0°. Second vacuum plate 30 is situated at second angle relative to horizontal, which is approximately −45°. Typically, the first and second angles are not equal. Typically, the first angle is between 30° and −30° relative to horizontal and said second angle is between −30° and −90° relative to horizontal. More typically, the first angle is between 5° and −5° relative to horizontal and said second angle is between −40° and −50° relative to horizontal. These angles are advantageous where the conveyor according to the present invention is employed to receive a workpiece from a rotary die cutter and deliver the workpiece downward into a laminating nip, as discussed more fully below.

First and second vacuum plates 20, 30 are mounted to a frame made up of one or more frame elements 40. Endless perforated belt 10 passes over a number of rollers 60, 70 rotatably mounted to frame elements 40. A first roller is hidden in FIGS. 1 and 2 by transfer plate 50. Endless perforated belt 10 passes over a second roller 60 and a third roller 70. Endless perforated belt 10 also passes through drive mechanism 80 powered by servo motor 90.

Figure 3:
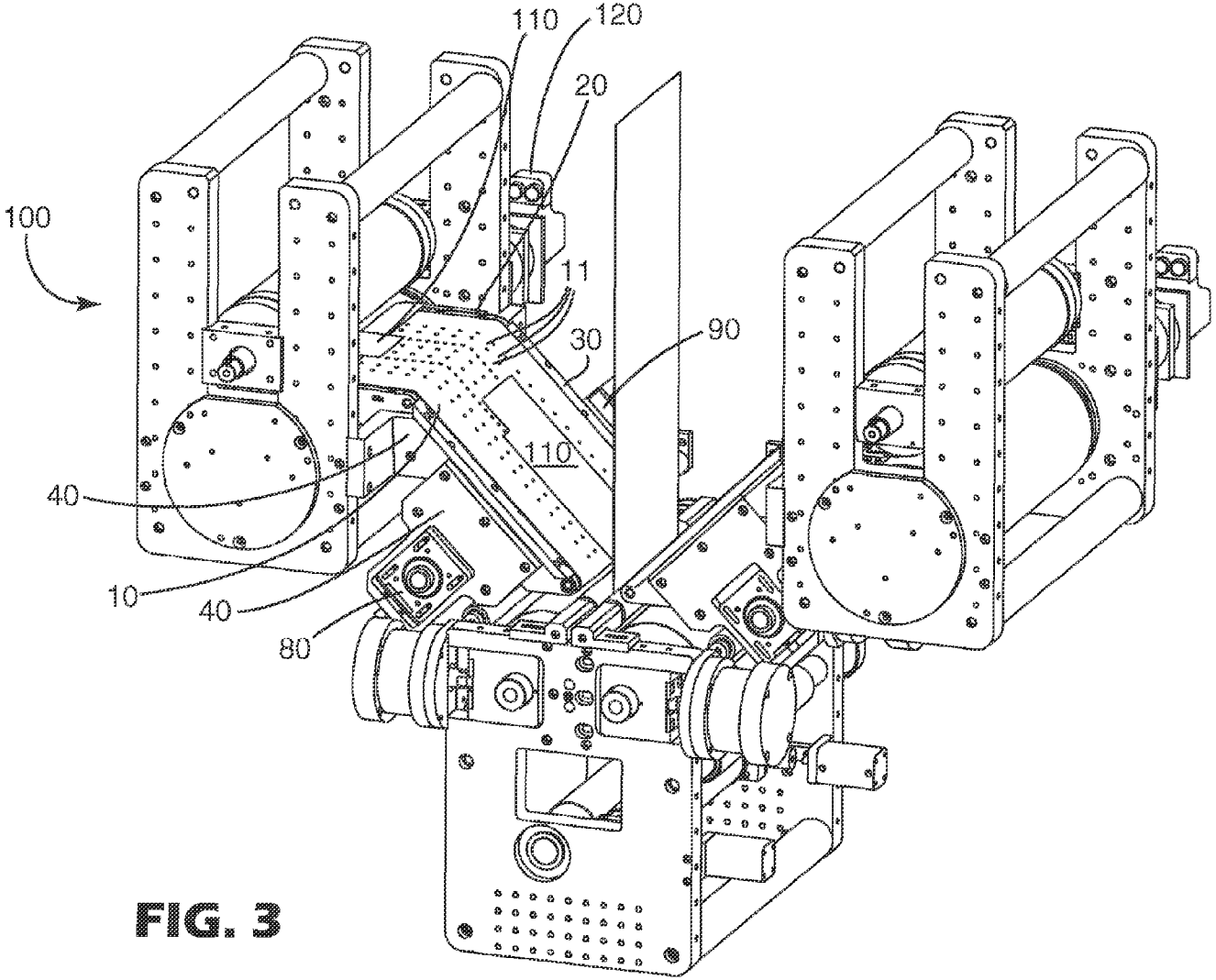
FIG. 3 illustrates the vacuum conveyor depicted in FIG. 1 together with the rotary die cutter and drive mechanism described in the specification below.

With reference to FIG. 3, the conveyor according to the present invention may be used to advantage in concert with a rotary die cutter (100) which cuts workpieces (110) from a web of workpiece material. The vacuum conveyor and the rotary die cutter are arranged such that an emerging portion of a workpiece (110) being cut from the web of workpiece material can become held by the action of the first sub-ambient pressure in the first vacuum chamber, drawing air through the first vacuum plate and the endless perforated belt (10), before the workpiece (110) is fully separated from the web of workpiece material. The drive mechanism (90) for propelling the endless perforated belt may be geared with the drive mechanism (120) driving the rotary die cutter. Gearing may be accomplished by any suitable method of gearing or synchronization, including mechanical and electronic gearing. The linear surface velocity of the endless perforated belt (10) may be equal to or greater than the linear surface velocity of the rotary die cutter (100). A greater velocity enables the conveyor to space apart workpieces (110) as they emerge from the cutter (100).

In one embodiment, this web is catalyst decal material, which comprises a thin layer of a catalyst dispersion on a backing layer. In this embodiment, the conveyor according to the present invention transports pattern-cut workpieces of this catalyst decal material from a rotary die cutter to a laminating nip. At the laminating nip, the catalyst is laminated onto a membrane, which is polymer electrolyte membrane, to form a membrane electrode assembly used in the manufacture of fuel cells. The decal backing layer is subsequently removed. In this embodiment, two rotary die cutters and two vacuum belt conveyors are employed to deliver symmetrical workpieces to each side of the laminating nip simultaneously. The conveyors according to the present invention can take hold of pattern-cut workpieces before they are fully cut and transport them under positive grip, and can therefore deliver them to both sides of the laminating nip simultaneously with accurate registration.

This invention is useful in the manufacture of articles laminated on two sides with pattern-cut sheet materials in accurate registration, which might include fuel cell membrane electrode assemblies. Pattern-cut sheet materials or workpieces are typically shapes other than four-sided parallelograms, which might be made by knife cutting mechanisms. More typically, pattern-cut sheet materials or workpieces are die-cut or rotary die-cut. Accurate registration typically means that the perimeters of the pattern-cut sheet materials match to within 1 mm, more typically 0.5 mm, more typically 250 μm, and more typically 125 μm.

Various modifications and alterations of this invention will become apparent to those skilled in the art without departing from the scope and principles of this invention, and it should be understood that this invention is not to be unduly limited to the illustrative embodiments set forth hereinabove. All publications and patents are herein incorporated by reference to the same extent as if each individual publication or patent was specifically and individually indicated to be incorporated by reference.

The invention claimed is:

1. An apparatus for cutting and transporting sheet materials comprising:

I) a vacuum conveyor for transporting sheet materials comprising an endless perforated belt, wherein said perforated belt extends over a first vacuum plate situated at a first angle relative to horizontal having first longitudinal openings, and wherein said perforated belt extends over a second vacuum plate situated at a second angle relative to horizontal which is not equal to said first angle having second longitudinal openings; and II) a rotary die cutter, said rotary die cutter being adapted to cut a continuous web so as to form cut workpieces, wherein said vacuum conveyor and rotary die cutter are arranged such that an emerging portion of a cut workpiece becomes held by the action of a vacuum, drawn through said perforated belt and said first vacuum plate, before said cut workpiece is fully separated from said continuous web.

2. An apparatus for cutting and transporting sheet materials according to claim 1, wherein said first longitudinal openings communicate with a first vacuum chamber maintained at a first sub-ambient air pressure, and wherein said second longitudinal openings communicate with a second vacuum chamber maintained at a second sub-ambient air pressure.

3. An apparatus for cutting and transporting sheet materials according to claim 2 additionally comprising:

a frame, wherein a first roller is rotatably attached to said frame, said first vacuum plate is attached to said frame, a second roller is rotatably attached to said frame, said second vacuum plate is attached to said frame, and a third roller rotatably is attached to said frame, wherein said endless perforated belt passes over said rollers and plates in the recited order; and a drive mechanism for propelling said endless perforated belt over said rollers and plates.

4. An apparatus for cutting and transporting sheet materials according to claim 3 wherein said drive mechanism for propelling said endless perforated belt is geared with said rotary die cutter such that the linear surface velocity of said endless perforated belt is greater than the linear surface velocity of said rotary die cutter.

5. An apparatus for cutting and transporting sheet materials according to claim 1 wherein said first angle is between 30° and −30° relative to horizontal and said second angle is between −30° and −90° relative to horizontal; wherein said first longitudinal openings communicate with a first vacuum chamber maintained at a first sub-ambient air pressure, and wherein said second longitudinal openings communicate with a second vacuum chamber maintained at a second sub-ambient air pressure, wherein said second sub-ambient air pressure is not equal to said first sub-ambient air pressure; additionally comprising a first source of sub-ambient air pressure functionally connected to said first vacuum chamber and additionally comprising a second source of sub-ambient air pressure functionally connected to said second vacuum chamber.

6. An apparatus for cutting and transporting sheet materials according to claim 5 additionally comprising:

a frame, wherein a first roller is rotatably attached to said frame, said first vacuum plate is attached to said frame, a second roller is rotatably attached to said frame, said second vacuum plate is attached to said frame, and a third roller rotatably is attached to said frame, wherein said endless perforated belt passes over said rollers and plates in the recited order; and a drive mechanism for propelling said endless perforated belt over said rollers and plates.

7. An apparatus for cutting and transporting sheet materials according to claim 6 wherein said drive mechanism for propelling said endless perforated belt is geared with said rotary die cutter such that the linear surface velocity of said endless perforated belt is greater than the linear surface velocity of said rotary die cutter.

8. An apparatus for cutting and transporting sheet materials according to claim 1 additionally comprising:

a frame, wherein a first roller is rotatably attached to said frame, said first vacuum plate is attached to said frame, a second roller is rotatably attached to said frame, said second vacuum plate is attached to said frame, and a third roller rotatably is attached to said frame, wherein said endless perforated belt passes over said rollers and plates in the recited order; and a drive mechanism for propelling said endless perforated belt over said rollers and plates.

9. An apparatus for cutting and transporting sheet materials according to claim 8 wherein said drive mechanism for propelling said endless perforated belt is geared with said rotary die cutter such that the linear surface velocity of said endless perforated belt is greater than the linear surface velocity of said rotary die cutter.

* * * * *